US006109542A

United States Patent [19]

Morris et al.

[11] Patent Number: 6,109,542

[45] Date of Patent: Aug. 29, 2000

[54] SERVO-CONTROLLED FUEL INJECTOR WITH LEAKAGE LIMITING DEVICE

[75] Inventors: Corydon E. Morris; Gary L. Gant; George L. Muntean, all of Columbus, Ind.

[73] Assignee: Cummins Engine Company, Inc., Columbus, Ind.

[21] Appl. No.: 09/157,389

[22] Filed: Sep. 21, 1998

[51] Int. Cl.[7] ..... F02M 47/02

[52] U.S. Cl. ..... 239/88; 239/90; 239/91; 239/94; 239/95; 239/96; 239/124; 239/585.1

[58] Field of Search ..... 239/88, 90, 91, 239/93, 94, 95, 96, 124, 585.1, 585.2

[56] References Cited

U.S. PATENT DOCUMENTS

| | | | |
|---|---|---|---|
| 4,129,254 | 12/1978 | Bader, Jr. et al. . | |
| 4,440,132 | 4/1984 | Terada et al. . | |
| 4,527,737 | 7/1985 | Deckard . | |
| 4,603,671 | 8/1986 | Yoshinaga et al. . | |
| 4,674,688 | 6/1987 | Kanesaka | 239/96 X |
| 4,784,101 | 11/1988 | Iwanaga et al. . | |
| 4,948,049 | 8/1990 | Brisbon et al. . | |
| 5,133,645 | 7/1992 | Crowley et al. . | |
| 5,176,120 | 1/1993 | Takahashi . | |
| 5,333,786 | 8/1994 | Gant et al. . | |
| 5,335,861 | 8/1994 | Matusaka . | |
| 5,460,329 | 10/1995 | Sturman | 239/96 |
| 5,463,996 | 11/1995 | Maley et al. . | |
| 5,526,791 | 6/1996 | Timmer et al. . | |
| 5,551,634 | 9/1996 | Raab et al. | 239/96 |
| 5,638,791 | 6/1997 | Tsuzuki et al. . | |
| 5,676,114 | 10/1997 | Tarr et al. . | |
| 5,711,277 | 1/1998 | Fuseya . | |

FOREIGN PATENT DOCUMENTS 3239965 5/1984 Germany .

*Primary Examiner*—Andres Kashnikow
*Assistant Examiner*—Robin O. Evans
*Attorney, Agent, or Firm*—Nixon Peabody LLP; Charles M. Leedom, Jr.; Tim L. Brackett, Jr.

[57] ABSTRACT

A servo-controlled fuel injector is provided which includes a leakage limiting valve device for limiting the quantity of high pressure fuel available for leakage into the combustion chamber in the event the closed nozzle valve element fails to sealingly engage its seat between injection events. The servo-controlled fuel injector includes a control volume positioned adjacent an outer end of the nozzle valve element, a control volume charge circuit for supplying fuel to the control volume, a drain circuit for draining fuel from the control volume to a low pressure drain and an injection control valve positioned along the drain circuit for controlling the flow through the drain circuit so as to cause reciprocal movement of the nozzle valve element. The leakage limiting valve is integrated into the fuel injector body and positioned along a fuel transfer passage to block the flow of high pressure fuel to a nozzle cavity between injection events. The leakage limiting valve may be a cylindrical valve element positioned between the nozzle valve element and the injection control valve. Alternatively, the leakage limiting valve may be in the form of an annular valve sleeve slidably mounted on one end of the nozzle valve element so as to position the control volume immediately adjacent the injection control valve thereby minimizing the trapped volume and thus the valve response time.

20 Claims, 4 Drawing Sheets

SERVO-CONTROLLED FUEL INJECTOR WITH LEAKAGE LIMITING DEVICE

TECHNICAL FIELD

This invention relates to a fuel injector which effectively controls the timing, metering and flow rate of fuel injected into the combustion chamber of an engine while limiting inadvertent leakage into the combustion chamber.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection. However, these conventional injectors rely on injector or system components upstream of the nozzle assembly to determine the injection timing, metering and rate shape, and, therefore, may not provide the optimum control over the fuel injection event necessary for certain applications and to achieve certain objectives.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by optimizing the fuel injection timing, metering and injection flow rate for a particular application or set of operating conditions. For example, emissions may be minimized by decreasing the volume of fuel injected during the initial stage of an injection event while permitting a subsequent unrestricted injection flow rate. In other applications, pilot and multiple injections produce the optimal combustion event. As a result, many closed nozzle assemblies have been proposed for enabling more precise control of injection timing, quantity and flow rate throughout engine operation.

One way of more precisely controlling the movement of the needle valve element of a closed nozzle assembly and, therefore, more precisely controlling the fuel injection event, is disclosed in U.S. Pat. No. 5,676,114 issued to Tarr et al. and commonly assigned to the assignee of the present invention. A servo-controlled needle valve assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector.

U.S. Pat. No. 5,133,645 to Crowley et al. discloses a common rail fuel injection system having two common rails serving respective banks of injectors. Fuel is supplied to each rail by a respective cam-operated reciprocating plunger pump. Each injector includes a nozzle element positioned in a spring cavity which receives high pressure fuel from the common rail via a check valve. The spring cavity is also connected, via an orifice, to a pressure control volume positioned above the nozzle element. A solenoid operated control valve opens to connect the control volume to drain thereby initiating injection as fuel flows from the nozzle cavity through the orifice to drain, and closes to terminate injection.

In each of the fuel injectors discussed hereinabove, an undesirably large volume of high pressure fuel is available for injection between injection events. As a result, if the needle valve does not properly function to effectively block flow through the injector orifices between injection events, an unacceptably large amount of fuel will leak through the injector orifices into the combustion chamber between each injection event. This inadvertent fuel leakage may result in major engine damage due to engine oil dilution. Also, the fuel leakage into the combustion chamber may adversely affect combustion.

Consequently, there is a need for a fuel injector having a servo-controlled needle valve which minimizes fuel leakage into a combustion chamber between injection events while maintaining a compact, inexpensive injector assembly.

SUMMARY OF THE INVENTION

It is an object of the present invention, therefore, to overcome the disadvantages of the prior art and to provide a fuel injector which is capable of effectively and accurately controlling the metering and timing of fuel injection.

It is another object of the present invention to provide a servo-controlled injector having a minimal response time and multiple injection event capability.

It is another object of the present invention to provide a nozzle assembly capable of effectively controlling flow rate of fuel injected during each injection event so as to minimize emissions.

It is yet another object of the present invention to provide a fuel injector which includes an electronically actuated control valve capable of opening and closing with minimal response time under extremely high fuel pressure to begin and end each injection event.

It is a further object of the present invention to provide an injector which permits effective control of fuel injection metering and timing independent of injection pressure thereby minimizing emissions and optimizing fuel economy.

It is a still further object of the present invention to provide an injector capable of multiple injection events.

Still another object of the present invention is to provide an injector which minimizes the amount of fuel dumped to drain to minimize parasitic power losses.

Another object of the present invention is to provide a servo-controlled injector which avoids dilution of the engine oil by engine fuel thereby reducing the likelihood of engine damage.

Yet another object of the present invention is to provide a servo-controlled injector which minimizes the volume of fuel capable of leaking into the combustion chamber between injection events.

These and other objects of the present invention are achieved by providing a closed nozzle injector for injecting fuel from a high pressure fuel supply into the combustion chamber of an engine, comprising an injector body containing an injector cavity including a nozzle cavity and an injector orifice communicating with the nozzle cavity to discharge fuel into the combustion chamber. The injector body includes a fuel transfer circuit for transferring supply fuel to the injector orifice. A nozzle valve element is positioned in the nozzle cavity adjacent the injector orifice and movable between an open position in which fuel may flow from the transfer circuit through the orifice into the combustion chamber and a closed position in which fuel flow through the orifice is blocked. Movement of the nozzle valve element from the closed position to the open position and from the open position to the closed position defines an injection event during which fuel may flow through the injector orifice into the combustion chamber. A nozzle valve control device for moving the nozzle valve element between the open and closed positions is provided and includes a control volume positioned adjacent an outer end of the nozzle valve element and a control volume charge circuit for supplying fuel from the fuel transfer circuit to the control volume. The nozzle valve control device further includes a drain circuit for draining fuel from the control volume to a low pressure drain and an injection control valve positioned along the drain circuit for controlling the flow of fuel through the drain circuit so as to cause the movement of the nozzle valve element between the open and the closed positions. Importantly, a leakage limiting valve is positioned along the fuel transfer circuit for limiting the quantity of high pressure fuel available for leakage into the combustion chamber between injection events.

The closed nozzle injector of the present invention is designed so that movement of the injection control valve into the closed position automatically causes the leakage limiting valve to limit the quantity of high pressure fuel available for leakage into the combustion chamber. The leakage limiting valve may include a limiter valve member reciprocally mounted in the injector cavity for movement between open and closed positions. The limiter valve member and the nozzle valve element may have a common axis of reciprocation. Also, the injection control valve may have an axis of reciprocation common to both the limiter valve member and the nozzle valve element. The limiter valve member is reciprocally mounted in the injector cavity for movement between an open position permitting fluidic communication between the nozzle cavity and the high pressure fuel supply, and a closed position blocking fluidic communication between the nozzle cavity and the high pressure fuel supply. The injection control valve includes an injection control valve element movable between an open position causing drain flow through the drain circuit and a closed position blocking flow through the drain circuit. Movement of the injection control valve from the open to the closed position causes movement of the limiter valve member into the closed position and movement of the injection control valve from the closed position to the open position causes movement of the limiter valve member into the open position.

The limiter valve member may be positioned along a longitudinal axis of the injector body in nonoverlapping relationship between the injection control valve and the nozzle valve element. A bias spring may be provided for biasing the limiter valve member toward the closed position in such a way as to bias the limiter valve member toward the injection control valve and away from the injector orifice. The limiter valve member may alternatively include an annular valve sleeve reciprocally mounted on the outer end of the nozzle valve element for engaging an annular valve seat formed on the injector body. A bias spring may also be provided for biasing the annular valve sleeve toward the injector orifice and away from the injection control valve into a closed position. In this instance, the control volume may be positioned within an inner radial extent of the bias spring.

The injector body preferably includes a one-piece barrel, a first sliding surface formed on the barrel for sliding contact by the limiter valve member and a second sliding surface positioned a spaced axial distance along the injector body for guiding the nozzle valve element. The limiter valve member includes a valve end and an opposite end positioned in an actuation chamber. An injection rate control device may be provided for controlling the flow of fuel from the actuation chamber upon movement of the injection control valve into the open position so as to control the opening of the limiter valve member. The injection rate control device may include a flow orifice for permitting a restricted flow of fuel between the actuation chamber and the control volume.

DETAILED DESCRIPTION OF THE PREFERRED EMBODIMENT

Figure 1A:
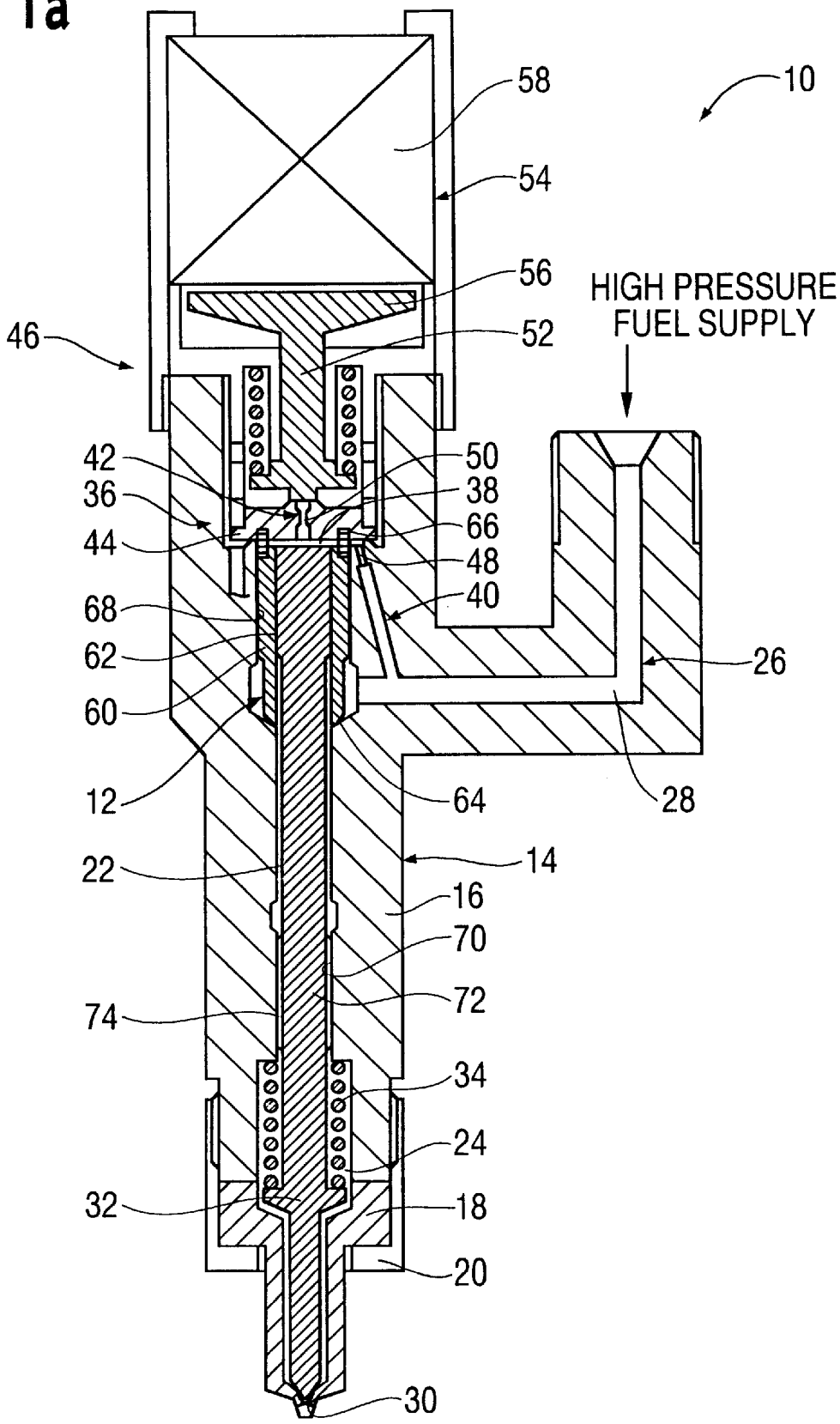
FIG. 1*a* is a cross sectional view of the servo-controlled fuel injector including the leakage limiting device of the present invention shown in the deactuated state between injection events.

Referring to FIG. 1, there is shown a preferred embodiment of the closed nozzle injector of the present invention, indicated generally at 10, incorporating the leakage limiting valve 12 of the present invention. Closed nozzle injector 10 generally includes an injector body 14 formed from a one-piece barrel 16, a nozzle housing 18 and a retainer 20. The one-piece barrel 16 and nozzle housing 18 are held in compressive abutting relationship by retainer 20. For example, the outer end of retainer 20 may contain internal threads for engaging corresponding external threads on one-piece barrel 16 to permit the entire injector body 14 to be held together by simple relative rotation of retainer 20 and one-piece barrel 16.

Injector body 14 includes an injector cavity, indicated generally at 22, which includes a nozzle cavity 24 formed in nozzle housing 18 and the lower end of one-piece barrel 16. Injector body 14 further includes a fuel transfer circuit 26 comprised of high pressure supply passage 28 and a portion of injector cavity 22 for delivering fuel from a high pressure source to nozzle cavity 24. Injector body 14 also includes one or more injector orifices 30 fluidically connecting nozzle cavity 24 with a combustion chamber of an engine (not shown).

The high pressure fuel supply to high pressure supply passage 28 may be supplied by one of a variety of sources, such as a relatively constant pressure source, i.e. a high pressure common rail or accumulator. Alternatively, a variable high pressure supply may be used, such as a dedicated pump assembly, such as in a pump-line-nozzle system or a unit injector system incorporating, for example a mechanically actuated plunger into the injector body. Another variable high pressure fuel supply that may be used in conjunction with the fuel injector of the present invention is disclosed in U.S. Pat. No. 5,676,114, the entire contents of which is hereby incorporated by reference.

Closed nozzle fuel injector 10 also includes a nozzle valve element 32 reciprocally mounted in injector cavity 22 and extending into nozzle cavity 24. A biasing spring 34 positioned in nozzle cavity 24 abuts a spring seat formed on nozzle valve element 32 so as to bias nozzle valve element 32 into a closed position blocking fuel flow through injector orifices 30. Closed nozzle injector 10 also includes a nozzle valve control device 36 including a control volume or cavity 38 formed adjacent the outer end of nozzle valve element 32 in injector cavity 22. Nozzle valve control device 36 further includes a control volume charge circuit 40 for directing fuel from high pressure supply passage 28 into control volume 38. In addition, nozzle valve control device 36 includes a drain circuit 42 formed partially in a spacer 44 for draining fuel from control volume 38 and an injection control valve 46 positioned along drain circuit 42 for controlling the flow of fuel through drain circuit 42 so as to cause controlled movement of nozzle valve element 32 between the open and closed positions. Control volume charge circuit 40 includes a supply orifice 48 while drain circuit 42 includes a drain orifice 50 formed in spacer 44.

Injection control valve 46 includes an injection control valve element 52 mounted for reciprocal movement between a closed position against spacer 44 and an open position permitting flow through drain circuit 42. An actuator assembly 54 is used to selectively move injection control valve element 52 between the open and closed positions. Actuator assembly 54 may be any type of actuator assembly capable of effectively and quickly moving injection control valve element 52 upon actuation of the assembly, i.e. a high speed solenoid actuator assembly. As shown in FIG. 1*a*, actuator assembly 54 may include an armature 56 connected to, or formed on, the outer end of injection control valve element 52 and a stator and coil assembly 58. Thus, in the de-energized state of FIG. 1*a*, injection control valve element 52 is positioned in the closed position blocking flow through drain circuit 42. Upon energization of actuator assembly 54, injection control valve element 52 moves into an open position permitting flow through drain circuit 42.

Leakage limiting valve 12 includes a limiter valve member 60 in the form of an annular valve sleeve mounted on the outer end of nozzle valve element 32. Annular valve sleeve 60 includes a central bore 62 for slidably receiving the outer end of nozzle valve element 32 and sized to form a fluidic seal between nozzle valve element 32 and annular valve sleeve 60 while permitting reciprocal movement between the components. An annular valve seat 64 is formed on one-piece barrel 16 for sealing engagement by annular valve sleeve 60 when annular valve sleeve 60 is in the closed position as shown in FIG. 1*a*. When annular valve sleeve 60 is in the closed position, high pressure fuel in high pressure supply passage 28 is blocked from entering injector cavity 22. A bias spring 66 is positioned for abutment against the upper end of annular valve sleeve 60 for biasing annular valve sleeve 60 toward the closed position against annular valve seat 64. The upper end of bias spring 66 is seated against spacer 44.

One-piece barrel 16 includes a first sliding surface 68 formed adjacent annular valve sleeve 60 for sliding contact with sleeve 60. First sliding surface 68 is sized to create a fluidic seal between the surfaces to minimize fuel leakage through the sliding interface. One-piece injector barrel 16 also includes a second sliding surface 70 positioned on the lower portion of injector barrel 16 a spaced distance from first sliding surface 68. Second sliding surface 70 functions to guide nozzle valve element 32 during reciprocal movement. Nozzle valve element 32 includes a guiding portion 72 sized for sliding movement against second sliding surface 70. In addition, nozzle valve element 32 includes axial grooves 74 formed in the outer surface of guiding portion 72 for permitting unrestricted fuel flow from the upper portion of injector cavity 22 into nozzle cavity 24. In this manner, one-piece injector barrel 16 minimizes the number of high pressure joints in the injector body while providing effective guiding of nozzle valve element 32 and sealing of injector cavity 22.

Figure 1B:
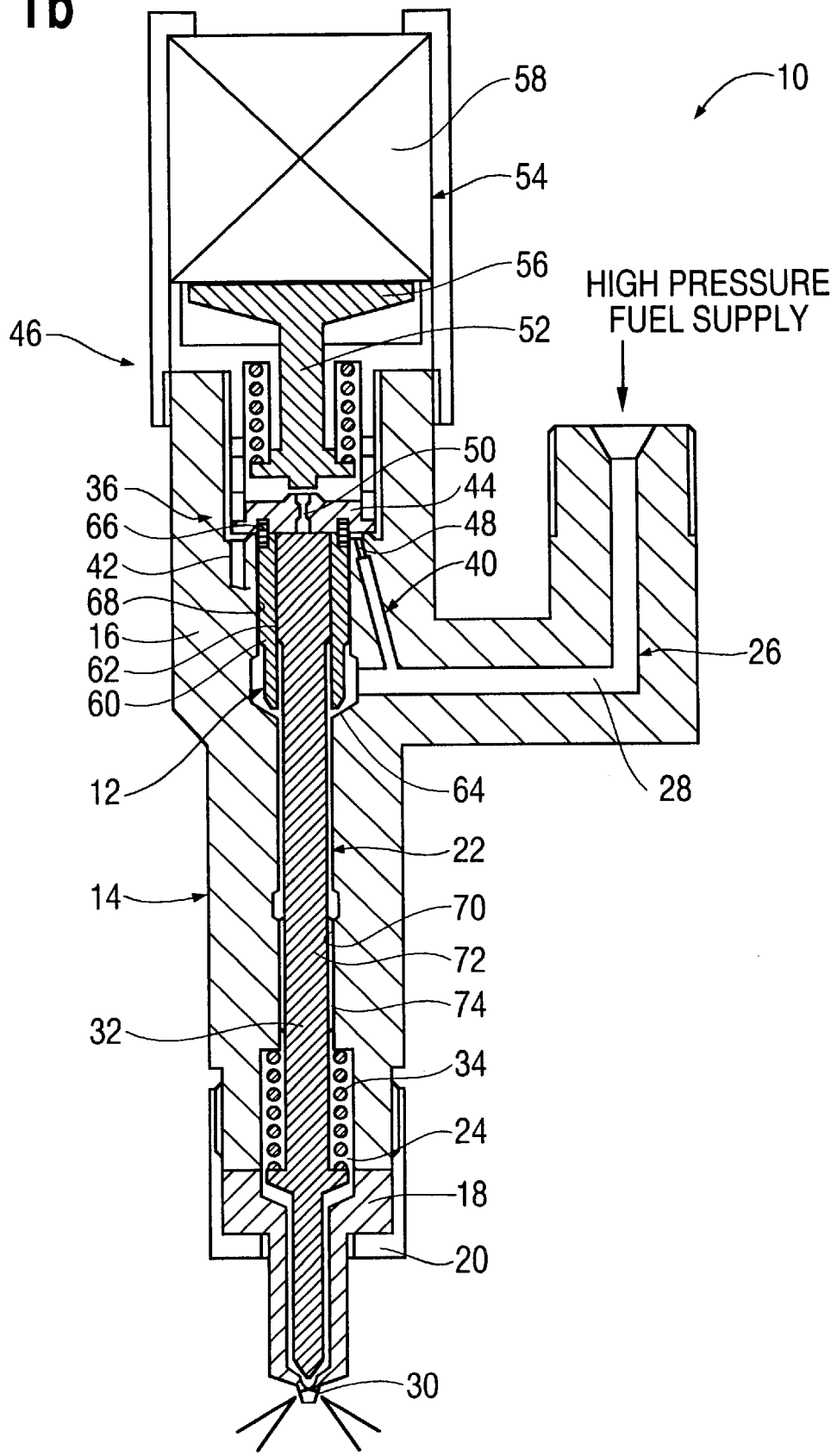
FIG. 1*b* is a cross sectional view of the fuel injector of FIG. 1*a* in the actuated state with the injection control valve, leakage limiter valve and nozzle valve element in the open positions.

During operation, prior to an injection event, actuator assembly 54 is de-energized and injection control valve element 52 biased into the closed position blocking flow through drain circuit 42 as shown in FIG. 1*a*. At the same time, limiter valve member 60 is positioned in the closed position against annular valve seat 64 blocking fluidic communication between high pressure supply passage 28 and injector cavity 22. Also, nozzle valve element 32 is positioned in the closed position blocking flow from nozzle cavity 24 through injector orifices 30. Upon energization of actuator assembly 54, armature 56 is attracted to stator and coil assembly 58 causing upward movement of injection control valve element 52 into the open position permitting fuel flow from control volume 38 through drain orifice 50 and drain circuit 42 to a low pressure drain. The ratio of the cross sectional areas of drain orifice 50 and supply orifice 48 is such that the flow from control volume 38 causes a decrease in pressure in control volume 38 resulting in upward movement of limiter valve member 60 toward the open position. It should be noted that the net pressure force acting on limiter valve member 60 when in the closed position is zero so that the relatively small biasing force of spring 66 functions to maintain limiter valve member 60 in the closed position. When the pressure in control volume 38 decreases, pressure imbalancing of limiter valve member 60 is reached prior to any movement of nozzle valve element 32. Thus limiter valve member 60 begins to open prior to the opening of nozzle valve element 32. When limiter valve member 60 opens, high pressure fuel from supply passage 28 flows into injector cavity 22 and nozzle cavity 24 and acts on the exposed surfaces of nozzle valve element 32. This increase in the pressure forces tending to open element 32 combined with a decrease in pressure in control volume 38, and thus a decrease in the pressure forces tending to close element 32, causes element 32 to move from the closed position into an open position thus marking the beginning of the injection event as shown in FIG. 1*b*. After a predetermined time period as determined by an engine electronic control unit (not shown) based on engine operating conditions, actuator assembly 54 is de-energized causing injection control valve element 52 to move into the closed position blocking flow through drain circuit 42. However, high pressure fuel continues to flow through supply orifice 48 into control volume 38 increasing the pressure in control volume 38. As the pressure in control volume 38 increases, the net pressure forces acting downwardly on nozzle valve element 32, in combination with the biasing force of biasing spring 34, will overcome the net pressure forces acting upwardly on nozzle valve element 32 thereby causing element 32 to return to the closed position blocking flow through injector orifices 30 thereby ending the injection event as shown in FIG. 1*a*. Subsequently, limiter valve member 60 will also be moved into the closed position by pressure forces in combination with the biasing force of spring 66.

Between injection events, limiter valve member 60 effectively prevents the flow of high pressure fuel from the high pressure fuel supply into injector cavity 22 thereby minimizing fuel flow through injector orifices 30 in the event nozzle valve element 32 fails to properly block the flow through injector orifices 30. It has been found that in certain situations, nozzle valve element 32 fails to close, for example, due to interfering particles preventing nozzle valve element 32 from properly seating on its valve seat. Also, nozzle valve element 32 may malfunction due to a structural defect. In conventional injector assemblies, high pressure supply fuel would flow through the injector cavity and the injector orifices into the combustion chamber causing dilution of the engine lubricating oil and thus possible engine damage. Leakage limiting valve 12 of the present invention, however, effectively blocks the flow of high pressure fuel to nozzle cavity 24 thereby preventing an unlimited high pressure fuel flow to injector orifices 30 between injection events. In addition, leakage limiting valve 12 is integrated into the injector body 14 so as to minimize the volume of high pressure fuel remaining in injector cavity 22 and available for injection through injector orifices 30 after the closing of limiter valve member 60 and upon malfunction of nozzle valve element 32.

The present embodiment also functions to minimize the size of the control volume 38, i.e. trapped volume, thereby decreasing the response time between the opening of injection control valve element 52 and the movement of nozzle valve element 32 toward the open position at the beginning of an injection event. As shown in FIGS. 1*a* and 1*b*, control volume 38 is positioned in close proximity to injection control valve element 52 and its seating surface formed on spacer 44 thereby minimizing the volume of fuel that must be depressurized and pressurized during each injection event. As a result, the response time of the nozzle valve element 32 is significantly reduced thereby permitting more precise control over fuel injection metering and timing. Closed nozzle injector 10 effectively reduces control volume 38 while permitting injector 10 to be mounted on a variety of engines, including engines having restricted packaging requirements due to limited overhead space. The present invention achieves this result by forming an elongated nozzle valve element 32 which extends a substantial distance through injector body 14 and includes an outer end positioned immediately adjacent injection control valve 46. As a result, the relatively large injection control valve 46 is advantageously positioned a desirable distance from the lower portion of the injector so as to be capable of being mounted on the engines having restricted overhead space. Moreover, by utilizing injector cavity 22 as the fuel transfer circuit without the use of separate passages formed in barrel 16, the present design permits the lower part of the injector body to be much smaller in diameter and thus capable of fitting within the packaging constraints of various engines. Also, the elimination of parallel fuel passages in the injector body at the nozzle end of the injector provides increased injection pressure capability by avoiding thin walls and minimizing stress concentrations.

On a multiple cylinder engine if one or more injectors are defective in such a way as to allow unwanted leakage into the combustion chamber (e.g. a defective nozzle) and the location of the defective injectors are determined (e.g. by computer software or other means), the present invention allows the defective injector(s) to be turned off while allowing all the remaining injectors to continue to function in the normal way. Thus a "limp home" capability is provided. This is possible due to the presence of the leakage limiting device 12. When the injector control valve(s) 46 on the defective injectors are de-energized, the limiter valve will remain closed preventing fuel from flowing to the defective nozzle.

Figure 2A:
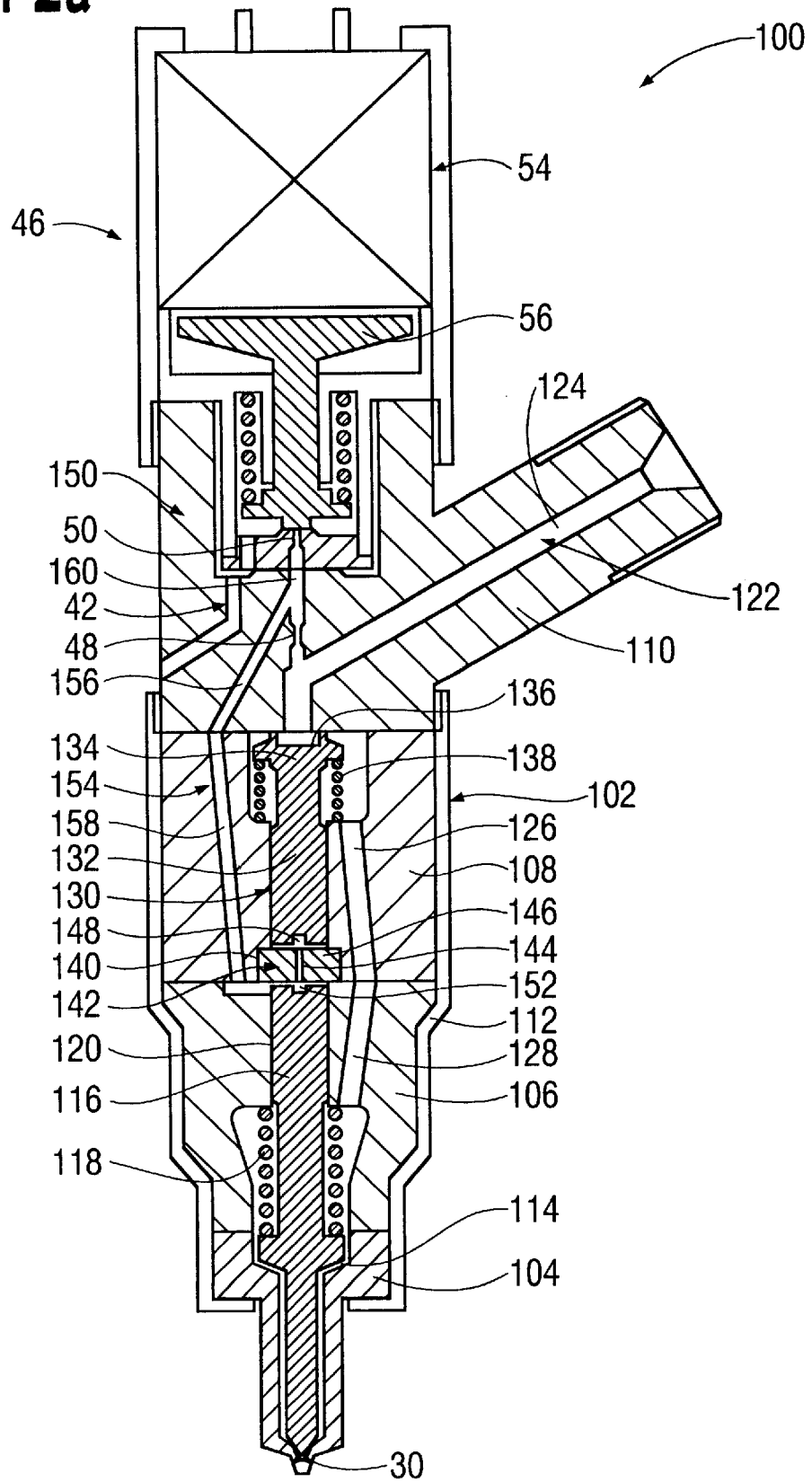
FIG. 2*a* is a cross sectional view of a second embodiment of the servo-controlled fuel injector of the present invention in the deactuated state.
Figure 2B:
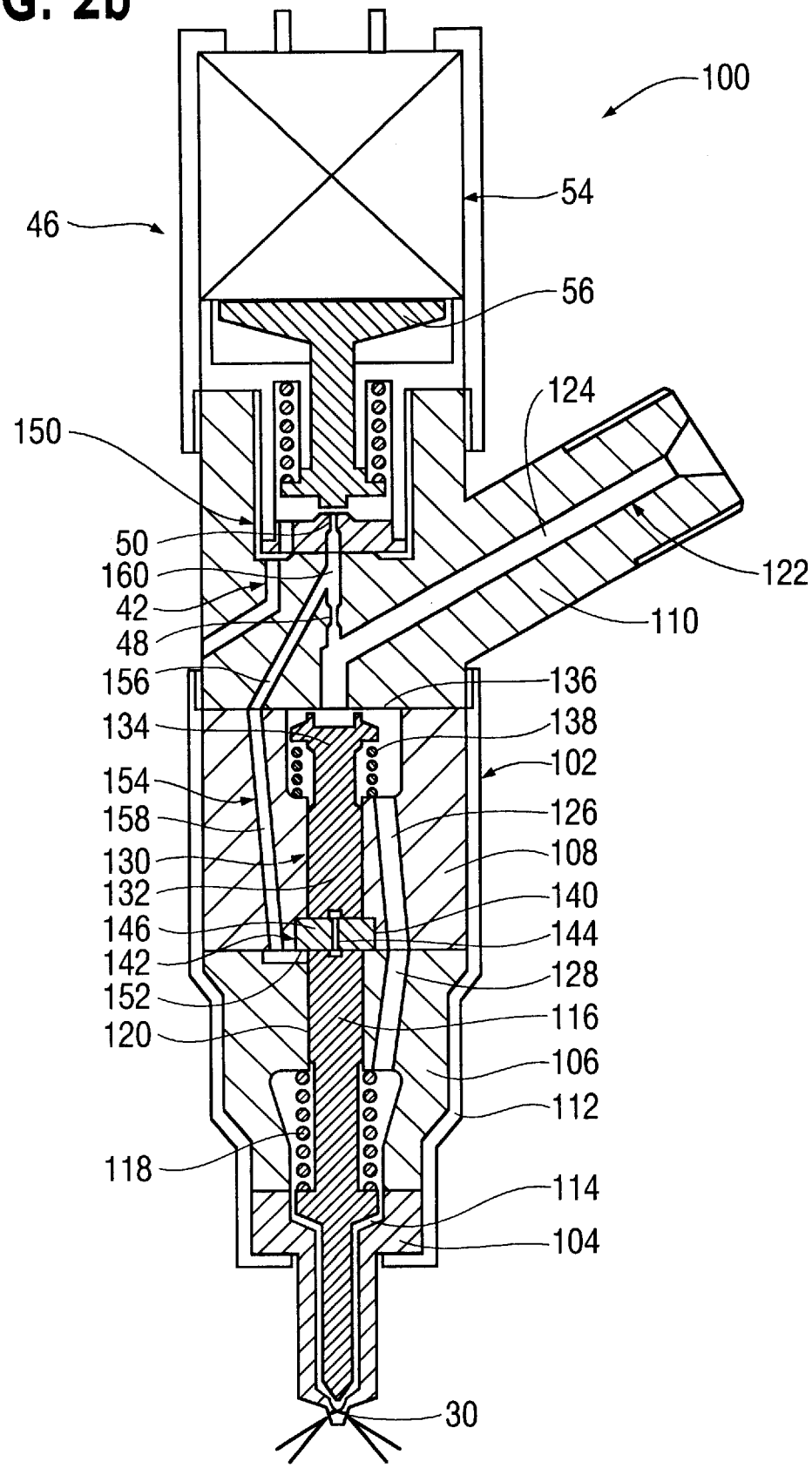
FIG. 2*b* is a cross sectional view of the fuel injector of FIG. 2*a* in the actuated state.

Referring now to FIGS. 2*a* and 2*b*, a second embodiment of the fuel injector of the present invention, indicated generally at 100, is shown. Closed nozzle fuel injector 100 is similar in some aspects to the embodiment of FIGS. 1*a* and 1*b* and therefore like reference numerals will be used to refer to the same or similar features in each embodiment. Closed nozzle injector 100 includes a more conventional injector body 102 comprised of a nozzle housing 104, a spring housing 106, an inner barrel 108 and an outer barrel 110 held together in compressive abutting relationship by a retainer 112. Injector body 102 includes a nozzle cavity 114 formed in nozzle housing 104 and spring housing 106 for receiving a nozzle valve element 116 and a bias spring 118. A needle bore 120 is formed in the outer end of spring housing 106 for receiving the outer end of nozzle valve element 116 so as to permit reciprocal movement of element 116 relative to spring housing 106 while creating a fluidic seal between the components. The opposite end of injector body 102 includes the actuator assembly 54 and injection control valve 46 including injection control valve element 52 mounted on outer barrel 110 similar to the previous embodiment. A fuel transfer circuit 122 includes a passage 124 formed in outer barrel 110, a fuel passage 126 formed in inner barrel 108 and a passage 128 extending through spring housing 106 for connecting passage 126 to nozzle cavity 114.

A leakage limiting valve 130 is provided in inner barrel 108 and includes a limiter valve member 132 mounted in coaxial alignment with nozzle valve element 116 so as to have a common axis of reciprocation with both nozzle valve element 116 and injection control valve element 52. The upper end of limiter valve member 132 includes a valve end 134 for positioning against an annular valve seat 136 formed on the lower surface of outer barrel 110. Annular valve seat is formed around the opening of fuel passage 124 so as to permit limiter valve member 132 to block the flow through fuel transfer circuit 122 when limiter valve member 132 is in the closed position as shown in FIG. 2*a*. Limiter valve 132 is biased into the closed position by a bias spring 138. The lower end of inner barrel 108 includes a recess 140 for receiving an injection rate control device 142 for controlling the rate of opening of limiter valve member 132 and thus the rate of opening of nozzle valve element 116 thereby controlling the injection flow rate during the initial stage of injection as described more fully hereinbelow. Injection rate control device 142 includes a flow orifice 144 formed in an insert 146 securely clamped into position in recess 140 during assembly of the injector body components. The lower end of limiter valve member 132 and the upper surface of insert 146 form an actuation chamber 148 therebetween for receiving fuel for moving limiter valve member 132 into the closed position.

The present injector also includes nozzle valve control device 150, which in addition to injection control valve 46, includes a control volume 152 positioned at the outer end of nozzle valve element 116. In this manner, flow orifice 144 connects control volume 152 to actuation chamber 148. Nozzle valve control device 150 also includes a control volume charge circuit 154 including a passage 156 formed in outer barrel 110 and a passage 158 extending through inner barrel 108 to connect passage 156 to control volume 152. Passage 156 connects at an opposite end to a branch passage 158 extending between supply passage 124 and drain orifice 50 formed at one end of branch passage 160. In this embodiment, supply orifice 48 is positioned at the opposite end of branch passage 160.

The operation of the present embodiment is essentially the same as the operation of the embodiment of FIGS. 1*a* and 1*b* except that injection rate control device 142 separates one end of the limiter valve member 132 from the control volume 152 and functions to slow the pressure decrease in actuation chamber 148 upon energization of actuator 54 and opening of injection control valve 46. Thus limiter valve member 132 will open at a slower rate than an embodiment wherein the flow of fuel between actuation chamber 148 and control volume 152 is unrestricted. As a result, nozzle valve element 116 opens at a slower rate and, therefore, the initial rate of injection is slower than the previous embodiment. This injection rate shaping effect may be beneficial in certain applications for reducing emissions.

As shown in FIG. 2*a*, prior to the injection event, injection control valve 46 is positioned in the closed position to cause the fuel pressure in control volume charge circuit 154 and control volume 152 to increase so as to maintain nozzle valve element 116 in the closed position. Likewise, the fuel pressure in actuation chamber 148 is also at the same pressure level as the high pressure fuel supply thereby causing limiter valve member 132 to move into the closed position blocking flow through fuel transfer circuit 122. Thus, if nozzle valve element 116 were improperly seated or malfunctions in some manner so as to permit fuel flow through injector orifices between injection events, only a minimum quantity of fuel existing in passages 126, 128 and nozzle cavity 114 would be available for leakage into the combustion chamber of an engine.

As shown in FIG. 2*b*, energization of actuator 54 and movement of injection control valve 46 into the open position causes the high pressure fuel in control volume charge circuit 154 and control volume 152 to flow through drain circuit 42 and drain orifice 50 lowering the pressure in control volume 152. As a result, the pressure in actuation chamber 148 also begins to decrease while the high pressure on the opposite valve end 134 of limiter valve member 132 is maintained at a high level thereby causing limiter valve member 132 to move into the open position at a slower rate defined in part by the cross sectional flow area of flow orifice 144. Subsequently, the pressure in control volume 152 decreases to a level such that the pressure forces tending to open nozzle valve element 116 are greater than those tending to close element 116 thereby causing the opening of nozzle valve element 116. The flow orifice 144 is thus sized to obtain the desired limiter valve member opening rate associated with the desired injection rate shape. The energization of actuator assembly 54 causes the closing of injection control valve 46 and the subsequent movement of nozzle valve element 116 into the closed position followed by the movement of limiter valve member 132 into its closed position thereby ending the injection event while minimizing the quantity of high pressure fuel available for leakage into the combustion chamber in the event the nozzle valve element 116 does not properly block flow through the injector orifices 30.

On a multiple cylinder engine if one or more injectors are defective in such a way as to allow unwanted leakage into the combustion chamber (e.g. a defective nozzle) and the location of the defective injectors are determined (e.g. by computer software or other means), the present invention allows the defective injector(s) to be turned off while allowing all the remaining injectors to continue to function in the normal way. Thus a "limp home" capability is provided. This is possible due to the presence of the leakage limiting device 130. When the injector control valve(s) 46 on the defective injectors are de-energized, the limiter valve will remain closed preventing fuel from flowing to the defective nozzle.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require precise fuel injection metering and timing control in order to minimize emissions and to engines having restrictive packaging requirements. Such internal combustion engines including a fuel injector in accordance with the present invention can be widely used in all industrial fields and noncommercial applications, including trucks, passenger cars, industrial equipment, stationary power plants and others.

We claim:

1. A closed nozzle injector for injecting fuel from a high pressure fuel supply into the combustion chamber of an engine, comprising:

an injector body containing an injector cavity including a nozzle cavity and an injector orifice communicating with said nozzle cavity to discharge fuel into the combustion chamber, said injector body including a fuel transfer circuit for transferring supply fuel to said injector orifice;

a nozzle valve element positioned in said nozzle cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

a nozzle valve control means for moving said nozzle valve element between said open and said closed positions, said nozzle valve control means including a control volume positioned adjacent an outer end of said nozzle valve element, a control volume charge circuit for supplying fuel from said fuel transfer circuit to said control volume, a drain circuit for draining fuel from said control volume to a low pressure drain, and an injection control valve positioned along said drain circuit for controlling the flow of fuel through said drain circuit so as to cause the movement of said nozzle valve element between said open and said closed positions; and a leakage limiting valve means positioned along said fuel transfer circuit for limiting the quantity of high pressure fuel available for leakage into the combustion chamber between injection events.

2. The injector of claim 1, wherein said injection control valve is movable between open and closed positions, movement of said injection control valve into said closed position automatically causing said leakage limiting valve means to limit the quantity of high pressure fuel available for leakage into the combustion chamber.

3. The injector of claim 1, wherein said leakage limiting valve means includes a limiter valve member reciprocally mounted in said injector cavity for movement between open and closed positions, said limiter valve member and said nozzle valve element having a common axis of reciprocation.

4. The injector of claim 2, wherein said leakage limiting valve means includes a limiter valve member reciprocally mounted in said injector cavity for movement between open and closed positions, said limiter valve member, said nozzle valve element and said injection control valve having a common axis of reciprocation.

5. The injector of claim 1, wherein said leakage limiting valve means includes a limiter valve member reciprocally mounted in said injector cavity for movement between an open position permitting fluidic communication between said nozzle cavity and the high pressure fuel supply, and a closed position blocking fluidic communication between said nozzle cavity and the high pressure fuel supply, said injection control valve including an injection control valve element movable between an open position causing drain flow through said drain circuit and a closed position blocking flow through said drain circuit, wherein movement of said injection control valve from said open position to said closed position causes movement of said limiter valve member into said closed position and movement of said injection control valve from said closed position to said open position causes movement of said limiter valve member into said open position.

6. The injector of claim 5, wherein said limiter valve member is positioned along a longitudinal axis of said injector body in nonoverlapping relationship between said injection control valve and said nozzle valve element.

7. The injector of claim 6, wherein said leakage limiting valve means further includes a bias spring for biasing said limiter valve member toward said closed position, said bias spring biasing said limiter valve member toward said injection control valve and away from said injector orifice.

8. The injector of claim 5, wherein said limiter valve member includes an annular valve sleeve reciprocally mounted on said outer end of said nozzle valve element, said leakage limiting valve means further including an annular valve seat formed on said injector body for sealing contact by said annular valve sleeve.

9. The injector of claim 8, wherein said leakage limiting valve means further includes a bias spring for biasing said limiter valve member toward said closed position, said bias spring biasing said limiter valve member toward said injector orifice and away from said injection control valve.

10. The injector of claim 9, wherein said control volume is positioned within an inner radial extent of said bias spring.

11. The injector of claim 8, wherein said injector body includes a one-piece barrel, a first sliding surface formed on said one-piece barrel for sliding contact by said limiter valve member, and a second sliding surface positioned a spaced axial distance along said one-piece barrel for guiding said nozzle valve element.

12. The injector of claim 7, wherein said limiter valve member includes a valve end and an opposite end, said opposite end positioned in an actuation chamber, further including an injection rate control means for controlling the flow of fuel from said actuation chamber upon movement of said injection control valve into said open position so as to control the opening of said limiter valve member.

13. The injector of claim 12, wherein said injection rate control means includes a flow orifice for permitting a restricted flow of fuel between said actuation chamber and said control volume.

14. A closed nozzle injector for injecting fuel from a high pressure fuel supply into the combustion chamber of an engine, comprising:

an injector body containing an injector cavity including a nozzle cavity and an injector orifice communicating with said nozzle cavity to discharge fuel into the combustion chamber, said injector body including a fuel transfer circuit for transferring supply fuel to said injector orifice;

a nozzle valve element positioned in said nozzle cavity adjacent said injector orifice, said nozzle valve element movable between an open position in which fuel may flow from said fuel transfer circuit through said injector orifice into the combustion chamber and a closed position in which fuel flow through said injector orifice is blocked;

a nozzle valve control means for moving said nozzle valve element between said open and said closed positions, said nozzle valve control means including a control volume positioned adjacent an outer end of said nozzle valve element, a control volume charge circuit for supplying fuel from said fuel transfer circuit to said control volume, a drain circuit for draining fuel from said control volume to a low pressure drain, and an injection control valve positioned along said drain circuit for controlling the flow of fuel through said drain circuit so as to cause the movement of said nozzle valve element between said open and said closed positions, said injection control valve including an injection control valve element movable between an open position causing drain flow through said drain circuit and a closed position blocking flow through said drain circuit; and a leakage limiter valve positioned along said fuel transfer circuit and reciprocally mounted for movement between an open position permitting fluidically communication between said nozzle cavity and the high pressure fuel supply and a closed position blocking fluidic communication between said nozzle cavity and the high pressure fuel supply, wherein movement of said injection control valve from said open position to said closed position causes movement of said leakage limiter valve into said closed position and movement of said injection control valve from said closed position to said open position causes movement of said limiter valve member into said open position.

15. The injector of claim 14, wherein said leakage limiter valve and said nozzle valve element having a common axis of reciprocation.

16. The injector of claim 14, wherein said leakage limiter valve member is positioned along a longitudinal axis of said injector body in nonoverlapping relationship between said injection control valve and said nozzle valve element, further including a bias spring for biasing said leakage limiter valve toward said closed position, said bias spring biasing said leakage limiter valve toward said injection control valve and away from said injector orifice.

17. The injector of claim 14, wherein said leakage limiter valve includes an annular valve sleeve reciprocally mounted on said outer end of said nozzle valve element, said leakage limiter valve further including an annular valve seat formed on said injector body for sealing contact by said annular valve sleeve.

18. The injector of claim 17, further including a bias spring for biasing said leakage limiter valve toward said closed position, said bias spring biasing said leakage limiter valve toward said injector orifice and away from said injection control valve, said control volume being positioned within an inner radial extent of said bias spring.

19. The injector of claim 17, wherein said injector body includes a one-piece barrel, a first sliding surface formed on said one-piece barrel for sliding contact by said leakage limiter valve and a second sliding surface positioned a spaced axial distance along said one-piece barrel for guiding said nozzle valve element.

20. The injector of claim 16, wherein said leakage limiter valve includes a valve end and an opposite end, said opposite end positioned in an actuation chamber, further including an injection rate control means for controlling the flow of fuel from said actuation chamber upon movement of said injection control valve into said open position so as to control the opening of said leakage limiter valve, said injection rate control means including a flow orifice for permitting a restricted flow of fuel between said actuation chamber and said control volume.

* * * * *